US007775617B2

(12) United States Patent
Naoi et al.

(10) Patent No.: US 7,775,617 B2
(45) Date of Patent: Aug. 17, 2010

(54) PRINTING APPARATUS AND CONTROL METHOD OF THE PRINTING APPARATUS

(75) Inventors: Masaaki Naoi, Yokosuka (JP); Takayuki Ninomiya, Ichikawa (JP); Tadashi Matsumoto, Tokyo (JP); Kota Kiyama, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 338 days.

(21) Appl. No.: 11/944,970

(22) Filed: Nov. 26, 2007

(65) Prior Publication Data

US 2008/0122889 A1 May 29, 2008

(30) Foreign Application Priority Data

Nov. 28, 2006 (JP) ..... 2006-320539

(51) Int. Cl.
*B41J 29/38* (2006.01)

(52) U.S. Cl. ..... 347/14; 347/19; 347/16

(58) Field of Classification Search ..... 347/5, 347/9, 12, 14, 19, 20, 40–43, 49, 16, 57, 347/101
See application file for complete search history.

(56) References Cited

U.S. PATENT DOCUMENTS 5,841,448 A * 11/1998 Moriyama et al. ..... 347/19
6,609,845 B1 8/2003 Ninomiya
6,783,201 B2 8/2004 Ninomiya

FOREIGN PATENT DOCUMENTS

JP 2001-277673 10/2001

* cited by examiner

*Primary Examiner*—Thinh H Nguyen
(74) *Attorney, Agent, or Firm*—Fitzpatrick, Cella, Harper & Scinto

(57) ABSTRACT

In an ink jet printing apparatus using a plurality of printing heads arranged in a convey direction of a printing medium, an inclination angle of the printing medium to a predetermined convey direction is detected to adjust, in accordance with the resultant inclination angle, timings at which ink is jetted from the plurality of printing heads. This allows, even when the printing medium being subjected to a printing operation has a slight meander shape, an image to be formed on a printing medium so that printing positions of the plurality of printing heads have no dislocation.

5 Claims, 14 Drawing Sheets

PRINTING APPARATUS AND CONTROL METHOD OF THE PRINTING APPARATUS

BACKGROUND OF THE INVENTION

1. Field of the Invention

The present invention relates to a printing position control method of an ink jet printing apparatus by which an image is printed on a printing medium while using a plurality of printing heads.

2. Description of the Related Art

In recent years, more digital copiers or printers have been rapidly used. A digital copier or printer can provide color adjustment or image processing for example and thus has been a mainstream in the field of color printing apparatuses such as a color printer or a color copier. Recent printing apparatuses use printing methods such as an electronograph method, an ink jet method, or a thermal transfer method. Among these methods, the ink jet printing method is advantageous in satisfying three factors of the price of the apparatus, the printing quality, and the running cost. Due to this reason, digital color ink jet printing apparatuses have been useful in recent years ranging from a low-cost and small apparatus such as a home printer to a high-speed and large apparatus for office application.

By the way, more digital cameras have been recently used with a diffusion rate higher than that of silver salt cameras. Thus, large-scale retailers, which conventionally have provided a service for developing silver salt photographs and a print service, recently provide a digital print service for images taken by digital cameras. Such a retailer requires a large amount of print output within a short time and thus draws a roll-like printing medium to continuously convey the medium. Then, ink is discharged from a printing head having a width corresponding to that of the printing medium to print an image. Then, after the printing of the image is completed, the printed part is cut. Thus, a continuous paper as a roll paper does not need a cut processing in the manufacture thereof and thus requires a lower cost than that of a cut sheet and can be conveyed into the apparatus by a simpler structure than that for a cut sheet. Thus, an outputted printed matter can be provided with a relatively low cost while reducing the cost of the apparatus or a frequency at which the apparatus fails. Furthermore, the use of a printing head having a width corresponding to that of a printing medium combined with the continuous paper conveying of a printing medium can provide a higher printing speed.

An ink jet printing apparatus having the structure as described above desirably minimizes factors having an influence on a printing position (e.g., dispersion, inclination, or float of a convey accuracy for conveying a printing medium). Japanese Patent Laid-Open No. 2001-277673 discloses a method for printing a predetermined test pattern to read this pattern by a previously provided imaging section to use the reading result to compensate the printing position of the printing head.

However, the conventional method as disclosed in Japanese Patent Laid-Open No. 2001-277673 has been a method that is effective when the printing position of a printing head is significantly dislocated by a distance than can be visually recognized. Thus, in a situation in recent years where a printing resolution exceeds 1000 dpi (dot/inch), the conventional method could not sufficiently cope with the dislocated printing position. Furthermore, the method described in the above patent publication is a method to compensate a steadily-caused error based on information obtained based on a previously printed test pattern. Thus, this method could not cope with a slight meandering of a printing medium for example as caused in a printing operation.

The following section will describe the structure of an ink jet printing apparatus using such a printing medium printing head used in recent years and a defect owned by such a printing apparatus.

FIG. 5 is a schematic diagram of the structure illustrating the printing section of an ink jet printing apparatus using printing medium 6 and printing heads 1 to 4. The reference numerals 1 to 4 denote printing heads for respectively jetting inks of different colors that are arranged in a convey direction (direction X). In the following description, from the paper conveying side (the right side of the drawing), the first head 1, the second head 2, the third head 3, and the fourth head 4 are provided. The reference numeral 5 denotes a platen that supports a part of the back surface of the printing medium 6 printed by the printing heads 1 to 4.

The printing medium 6 wound to have a roll-like shape at the right side of the drawing is conveyed on the platen 5 in the direction X by a convey roller 7 and a follower roller 9 by being sent between positioning sections 11 to correct the inclination of the printing medium 6. The convey roller 7 is driven by the convey motor 8 and the follower roller 9 is driven by the follower motor 10, respectively. The follower motor 10 is driven with a torque slightly smaller than that of the convey motor 8. Thus, the printing medium on the platen 5 is smoothly conveyed while being pulled in the direction X.

The convey roller 7 includes a rotary encoder 12 for measuring the rotation amount thereof. The rotary encoder 12 outputs an encoder pulse signal 101 that is inputted to a direction X timing generation circuit 21. Based on the encoder pulse signal 101, the direction X timing generation circuit 21 outputs a direction X timing signal 102. A driving control circuit 22 controls, with an appropriate timing in accordance with the inputted direction X timing signal 102 and an interval among the individual printing heads, the timings at which ink is jetted through the respective printing heads 1 to 4 (driving timing).

FIG. 6 is a timing chart for explaining examples of timings of the encoder pulse signal 101, the direction X timing signal 102, and heat signals 103 to 106 of the first to fourth heads.

The number at which the encoder pulse signal 101 is outputted while the rotary encoder 12 is rotated one time is fixed. Thus, based on the inputted pulse number, the rotation amount of the color convey roller 7 (i.e., the convey amount of the printing medium 6) can be obtained. In accordance with the number of the encoder pulse 101 which is confirmed, the direction X timing generation circuit 21 outputs the direction X timing signal 102 with a timing suitable for the printing density in the direction X.

The driving control circuit 22 transmits, while being in synchronization with the direction X timing signal 102, the respective heat signals 103 to 106 for the printing heads 1 to 4 with a timing moved by a length corresponding to an interval among which the individual printing heads are arranged. The structure as described above allows, even when the convey roller is rotated with any rotation speed, color dots to be printed on a printing medium with a fixed printing density.

By the way, even when the printing medium 6 is prevented from having a significant inclination by being sent between the positioning sections 11 as in this example, there may be a case where the printing medium 6 has a slightly meander shape at a printing section after the positioning sections 11.

FIG. 7 is a schematic view illustrating how printing is performed when such a meandering of the printing medium 6 is caused. When the printing medium 6 while being conveyed has a meander shape, a printing region of the printing medium on the platen 5 is conveyed while having an inclination as shown in FIG. 7. The inclination amount is represented by θ.

The rotary encoder 12 directly measures a rotation amount of the convey roller 7. Thus, when the printing medium 6 is inclined with the shown inclination in the convey direction, an error is caused between an interval at which the encoder pulse signal is transmitted and the convey amount in the direction X of the printing medium 6. Specifically, $Vx=V\times COS\ \theta$ is established when assuming that a convey amount calculated based on the output of the rotary encoder is V and a practical convey amount in the direction X is Vx for example.

The driving control circuit 22 counts the direction X timing signal 102 obtained based on the encoder pulse signal 101 to generate the heat timing signals 103 to 106 of the respective printing heads. Thus, when the error as described above is included in the encoder pulse signal 101, a difference is caused among the timings at which ink is jetted through a plurality of printing heads. As a result, dots of the respective colors are printed on a printing medium at positions dislocated from one another, causing an image defect called as a color shift.

When an ink jet printing apparatus is provided as in this example so that the positioning sections 11 are provided at an appropriate position, the meandering amount can be suppressed to a certain level and can be reduced to a level that has been not problematic in the conventional structure. However, with the demand in recent years for a color image having a quality equal to that of a silver salt photograph, individual printing heads jet a small amount of ink droplets and thus significantly higher resolution is achieved by printing elements arranged in individual printing heads with a higher density and a higher printing resolution. In the circumstance as described above, even a color shift due to a printing medium having a meander shape during a printing operation is conspicuous as an image defect and is recognized as a problem that should be solved.

SUMMARY OF THE INVENTION

The present invention has been made in view of the above problem. Thus, it is an objective of the invention to provide a printing position control method by which an ink jet printing apparatus using a printing medium and a plurality of printing heads can be prevented, even when the printing medium being printed has a meander shape, from causing a dislocated printing position of the printing medium.

The first aspect of the present invention is a printing apparatus in which a convey means for conveying a printing medium and a plurality of printing heads including a plurality of printing elements arranged in a direction different from a direction along which the printing medium is conveyed are used to perform a printing operation, comprising: acquisition means for acquiring information for an angle formed by a reference direction with regards to the conveying of the printing medium and the convey direction along which the printing medium is conveyed by the convey means; driving means for driving the plurality of printing heads, respectively; and compensation means for compensating, based on the information for the angle, a driving timing of the driving means.

The second aspect of the present invention is a control method of a printing apparatus in which a convey means for conveying a printing medium and a plurality of printing heads including a plurality of printing elements arranged in a direction different from a direction along which the printing medium is conveyed are used to perform a printing operation, comprising the step of: acquiring information for an angle formed by a reference direction for the conveying of the printing medium and a convey direction of the printing medium by the convey means; driving the respective plurality of printing heads; and compensating, based on the information for the angle, a driving timing for the driving step.

Further features of the present invention will become apparent from the following description of exemplary embodiments (with reference to the attached drawings).

DESCRIPTION OF THE EMBODIMENTS

First Embodiment

Figure 1:
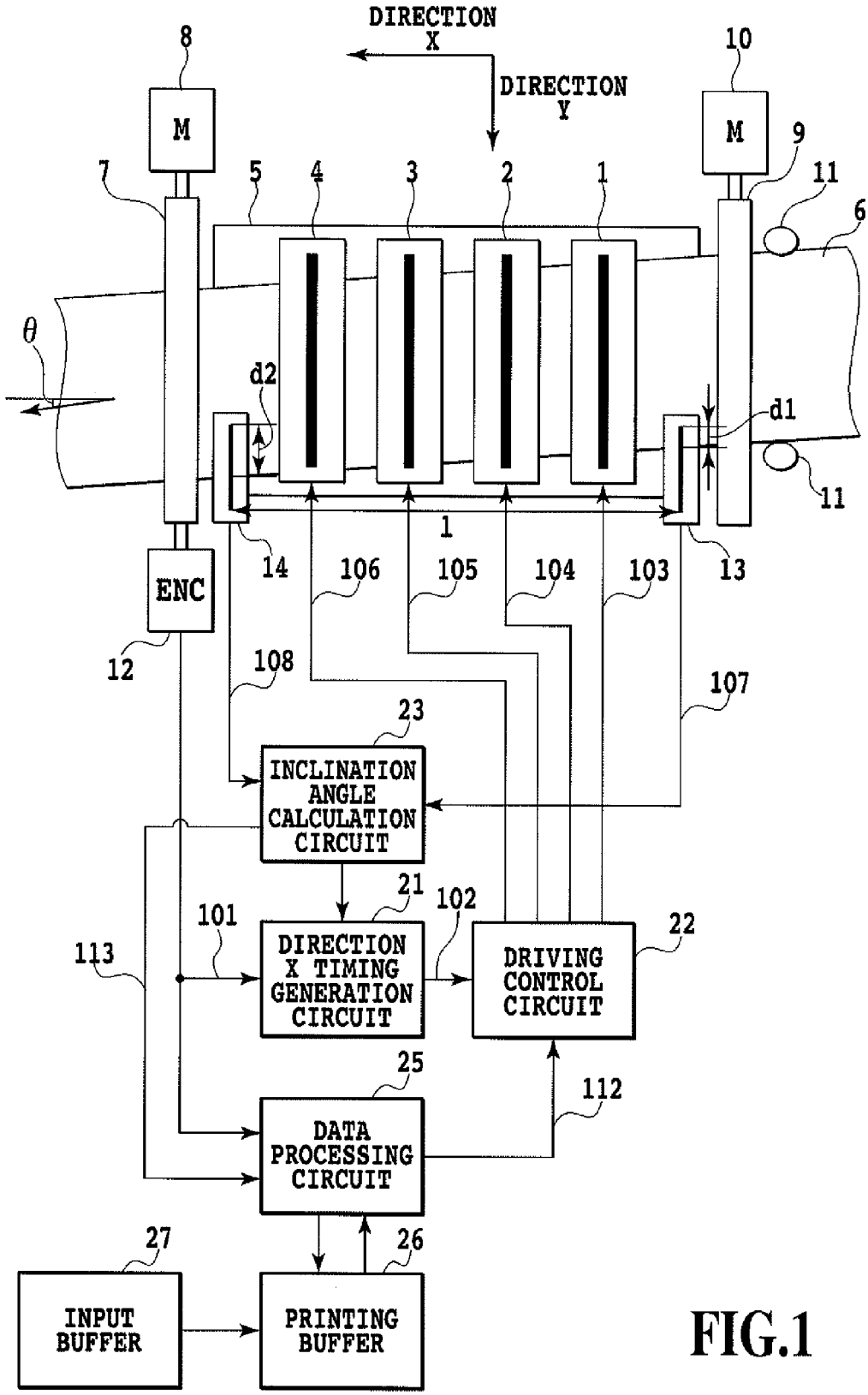
FIG. 1 is a schematic diagram for explaining the structure of the printing section of an ink jet printing apparatus used in the first embodiment of the present invention.
Figure 5:
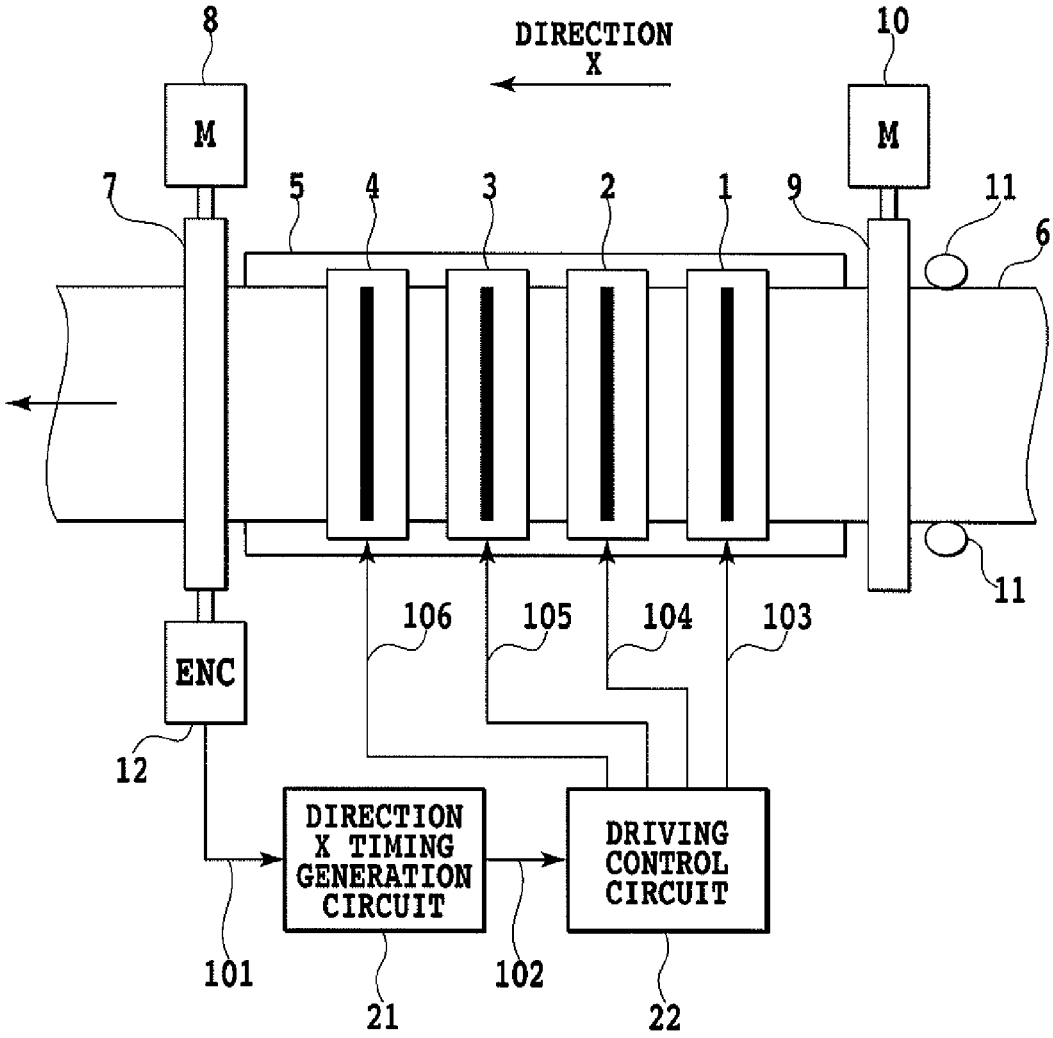
FIG. 5 is a schematic diagram for explaining the structure of a printing section of an ink jet printing apparatus using a printing medium and a printing head.
Figure 6:
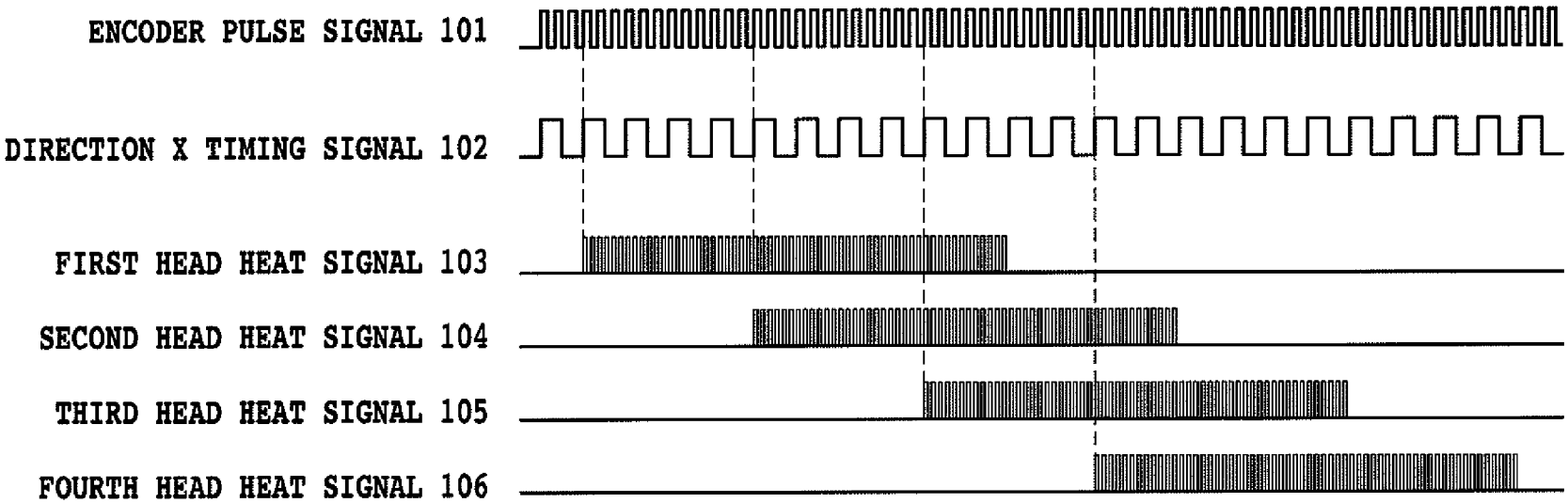
FIG. 6 is a timing chart for explaining examples of timings of encoder pulse signals, direction X timing signals, and heat signals of the first head to the fourth head.
Figure 7:
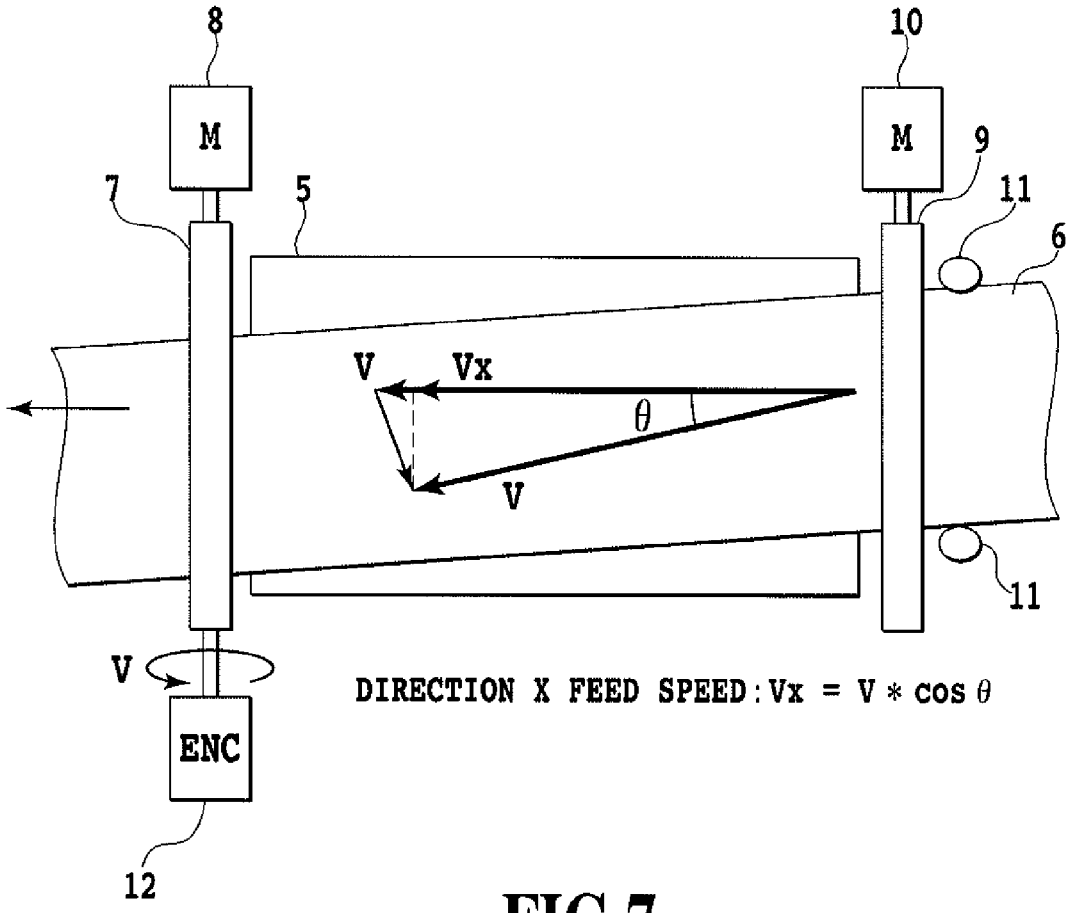
FIG. 7 is a schematic view illustrating how printing is performed when a printing medium having a meander shape is caused.

FIG. 1 is a schematic diagram for explaining the structure of a printing section of an ink jet printing apparatus used in the first embodiment in comparison with FIG. 5. As in the structure of FIG. 5, four printing heads jetting inks of different colors are arranged to be parallel to a convey direction. In the first embodiment, in order to measure the inclination of a printing medium, two line image sensors 13 and 14 are provided at the upstream and downstream sides of the convey path to the printing head 1 to 4, respectively. The line image sensors 13 and 14 are structured by arranging a plurality of sensor elements in a direction crossing the convey direction. When the printing medium 6 is conveyed below the line image sensors 13 and 14, a region at which the printing medium 6 actually passes is detected based on the number of sensor elements for which light therefrom is blocked or reflected by the printing medium 6. An inclination angle calculation circuit 23 calculates, based on read data 107 and 108 outputted from the respective line image sensors 13 and 14, the inclination angle θ of the printing medium 6. Specifically, a reference convey direction (reference direction) is previously provided to calculate an angle formed by a conveying direction of a printing medium conveyed by a convey means and the reference direction. In other words, an angle is calculated that represents how much a printing medium conveyed by a convey means inclines from the reference convey direction. Thereafter, the inclination angle calculation circuit 23 outputs the information 113 of the inclination angle θ to the timing generation circuit 21 and a data processing circuit 25.

Figure 13:
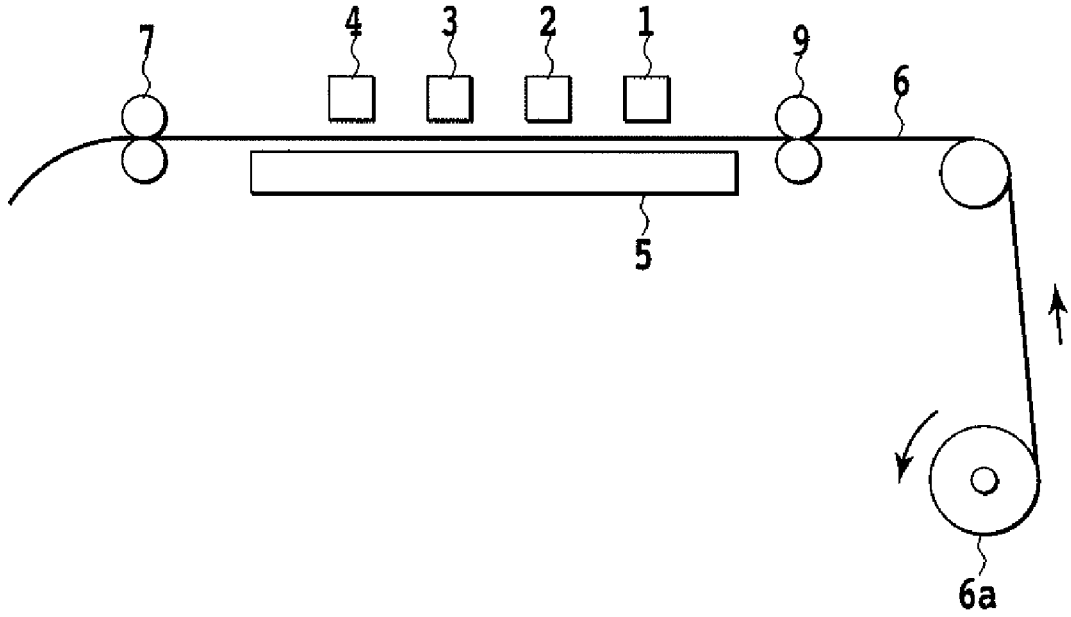
FIG. 13 is a schematic diagram for explaining the structure of the printing section of an ink jet printing apparatus used in the first embodiment of the present invention.

FIG. 13 is a schematic diagram for explaining the structure of a conveying section of the ink jet printing apparatus. For ease of explanation, other parts are cut. A printing medium 6 wound on a rotator as a roll-like shape is provided as a unit. The printing medium 6 may be a continuation sheet. The printing medium 6 is conveyed in the direction shown by an arrow by a convey roller 7 and a follower roller 9 from the unit and is printed by printing heads 1 to 4 on a platen 5.

In the first embodiment, image data inputted from outside and is stored in an input buffer 27 is converted to printing data that can be printed by the printing head and is subsequently stored in a printing buffer 26. Printing data for one pixel stored in the printing buffer 26 is read by the data processing circuit on the basis of one raster and is subjected to a predetermined compensation processing. The data processing circuit 25 of the first embodiment subjects, based on the inclination angle θ and position information of the individual printing heads, printing data for the respective rasters stored in the printing buffer 26 to a compensation processing for the inclination and a compensation processing for the direction Y.

On the other hand, the direction X timing generation circuit 21 subjects, based on the resultant information for the inclination angle θ, the data to a compensation processing for the direction X (convey direction). The driving control circuit 22 drives the printing heads 1 to 4 based on the timing compensated by the direction X timing generation circuit 21 and the printing data 112 compensated by the data processing circuit 25.

Figure 8A:
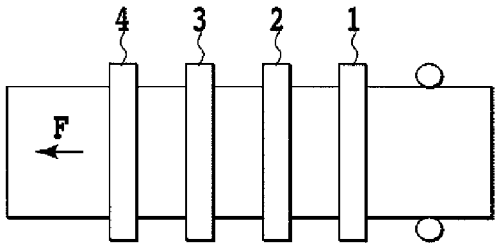
FIGS. 8A to 8D illustrate how a printing medium is conveyed and dots are printed when a printing medium has a meander shape after a printing operation is performed by the printing head 1.
Figure 8C:
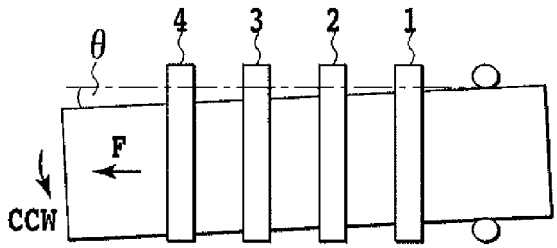
Figure 8B:
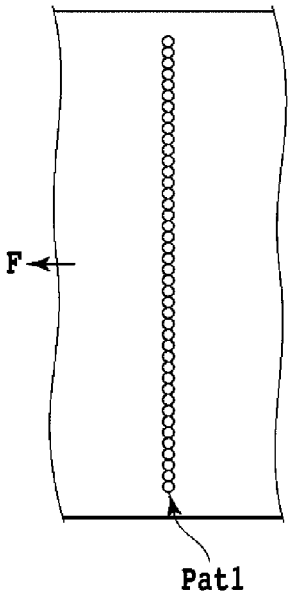
Figure 8D:
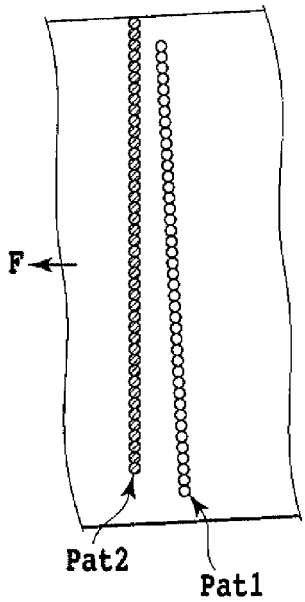

The following section will briefly describe an example of a dislocated printing position that can be compensated by the present invention. FIGS. 8A to 8D illustrate how a printing medium is conveyed and dots are printed when a printing medium has a meander shape after a printing operation is performed by the printing head 1. FIG. 8A shows a case where the printing medium does not have a meander shape and is conveyed in the reference direction. FIG. 8B shows a printing status of a line (Pat1) formed by ink jetted from a plurality of discharge openings provided in the printing head 1 in the status of FIG. 8A. FIG. 8C shows a status where the printing medium has a meander shape after the printing of Pat1 and is conveyed while being inclined by the angle θ from the reference direction in the direction shown by an arrow CCW (counterclockwise direction). FIG. 8D shows a printing status of a line (Pat2) formed by ink jetted from a plurality of discharge openings provided in the printing head 2 at an identical timing in the status of FIG. 8C. When Pat1 and Pat2 are printed on the printing medium having no meander shape by two printing heads, Pat1 and Pat2 draw two parallel lines. However, Pat1 and Pat2 are not parallel to each other in this example.

Figure 9A:
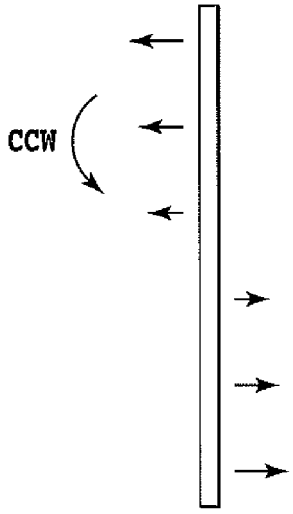
FIGS. 9A to 9C illustrate the types of compensations performed in the embodiment in order to improve the printing status as in FIG. 8D.
Figure 9B:
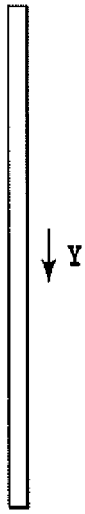
Figure 9C:
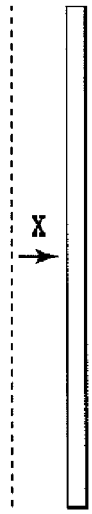

FIGS. 9A to 9C illustrate the types of compensations performed in the first embodiment in order to improve the printing status as in FIG. 8D. FIG. 9A illustrates the first compensation processing (i.e., angle compensation processing). In this processing, in order that the inclination amount on the printing medium caused by the meander shape of the printing medium is reduced to 0, a plurality of printing elements provided in the printing head 2 is subjected to discharge ink therefrom with appropriate different timings. FIG. 9A shows a case where the timings are compensated in the counterclockwise direction.

FIG. 9B illustrates the second compensation processing (i.e., a compensation processing in the direction Y orthogonal to the convey direction). In this illustrative embodiment, the direction Y is in the direction along which discharge openings are arranged. FIG. 9C illustrates the third compensation processing (i.e., a compensation processing in the reference direction (direction X) along which a printing medium is conveyed.

In this illustrative embodiment, the second compensation processing is performed by the data processing circuit 25 shown in FIG. 1 and the first compensation processing and the third compensation processing are performed by the direction X timing generation circuit 21.

Figure 10C:
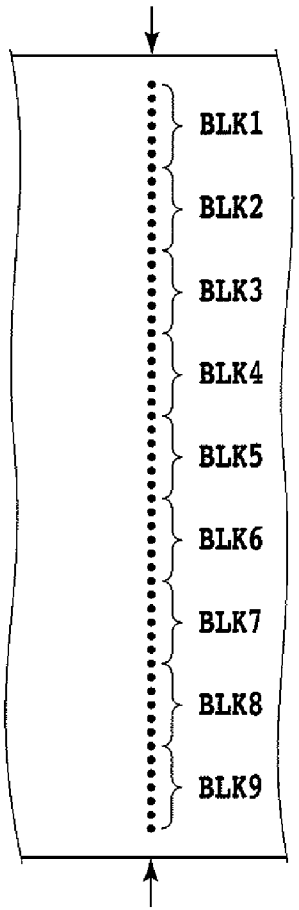
FIGS. 10A to 10C show blocks of a plurality of printing elements (discharge openings) provided in an arbitrary printing head, timings at which the individual blocks are driven, and a printing status of a printing medium when a compensation amount is 0.
Figure 10B:
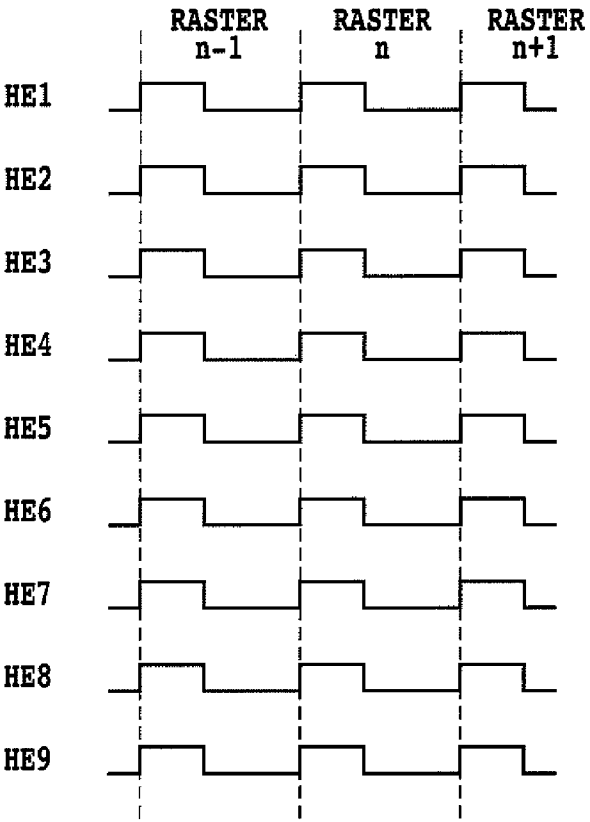
Figure 10A:
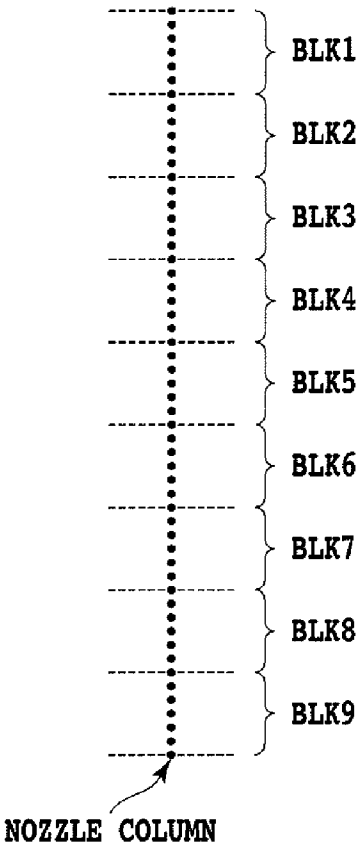

The following section will describe the first compensation processing method. FIGS. 10A to 10C show blocks of a plurality of printing elements (discharge openings) provided in an arbitrary printing head, timings at which the individual blocks are driven, and a printing status of a printing medium when a compensation amount is 0. A printing head of this illustrative embodiment is structured, as shown in FIG. 10A, so that a plurality of printing elements are divided to nine locks (BLK) in the arrangement direction to apply a driving voltage to each block. FIG. 10B illustrates driving voltage timing charts (HE1 to HE9) to the respective blocks (BLK1 to BLK9) when the compensation amount is 0. Since the compensation amount is 0, a pulse voltage is applied to all blocks with an identical timing. Dots printed caused by driving in the manner as described above are printed on a printing medium substantially in one line as shown in FIG. 10C.

Figure 11A:
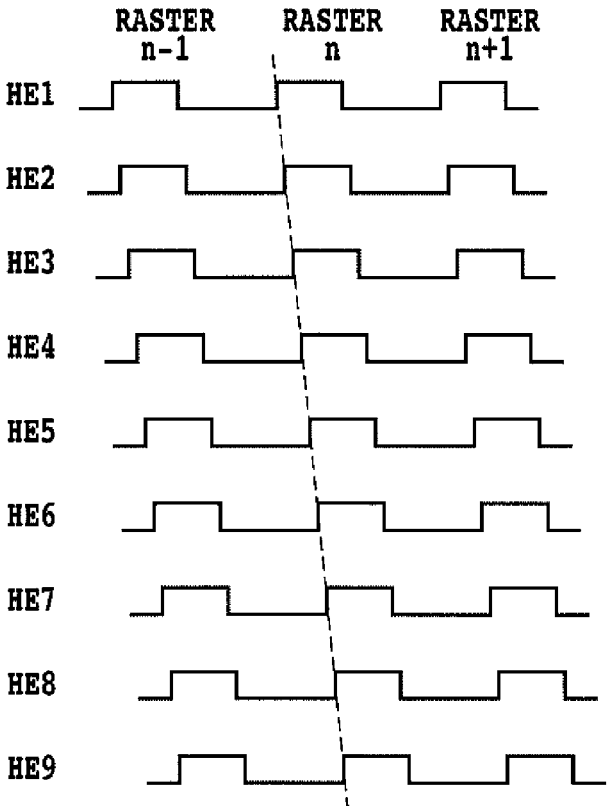
FIGS. 11A and 11B show driving timings of blocks BLK1 to BLK9 and a printing status of a printing medium in a case where a compensation in a counterclockwise direction by are performed as in FIGS. 10B and 10C.
Figure 11B:
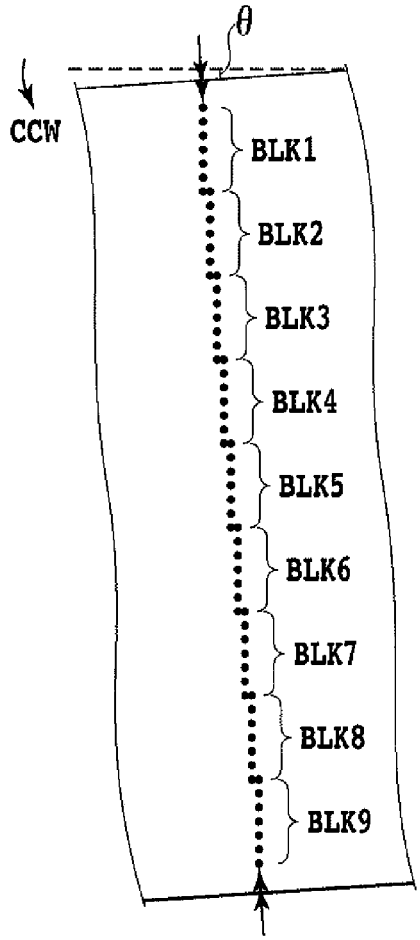

FIGS. 11A and 11B show a case where driving timings of the blocks BLK1 to BLK9 and a printing status of a printing medium are compensated in the counterclockwise direction by θ as in FIGS. 10B and 10C. With reference to FIG. 11A, the respective blocks BLK1 to BLK9 are sequentially driven with a fixed delay. Dots printed caused by driving in the manner as described above are arranged on a printing medium as shown in FIG. 11B. Specifically, the printed line is rotated in the counterclockwise direction when compared with a case of FIG. 10C in which the compensation amount is 0. However, in this illustrative embodiment, such compensation is performed when a printing medium is conveyed direction inclined by an angle θ as showed by an arrow (counterclockwise direction) from the reference of the convey direction. Thus, a line substantially parallel to the line shown in FIG. 10C is printed on the printing medium.

Figure 12A:
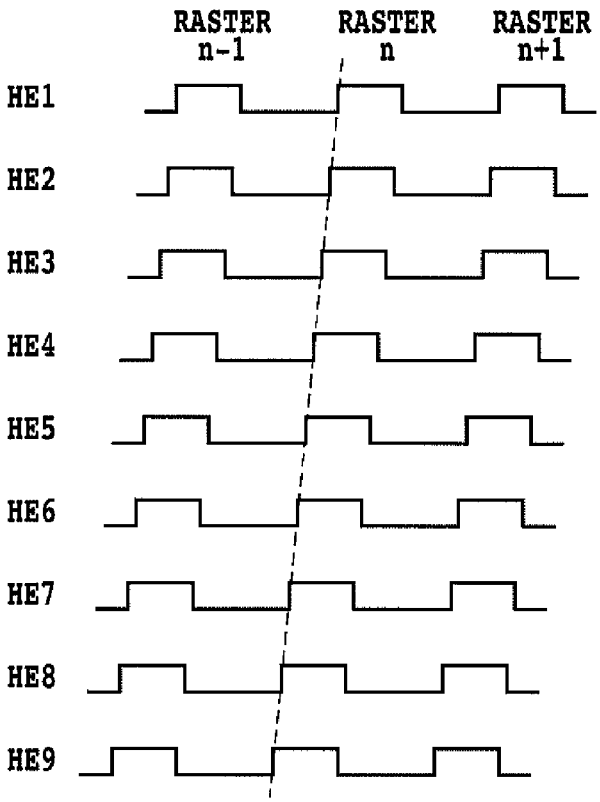
FIGS. 12A and 12B show a case where driving timings of the blocks BLK1 to BLK9 and a printing status of a printing medium in a case where a compensation in a clockwise direction by θ are performed as in FIGS. 10B and 10C.
Figure 12B:
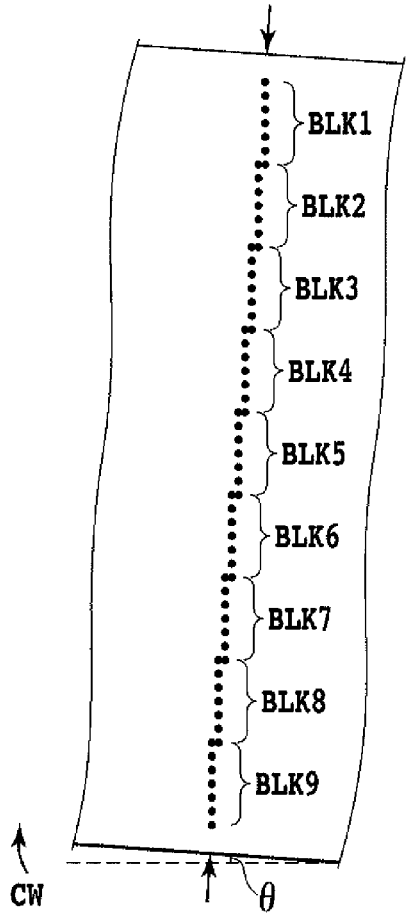

FIGS. 12A and 12B show a case where driving timings of the blocks BLK1 to BLK9 and a printing status of a printing medium are compensated in a clockwise direction by θ as in FIGS. 10B and 10C. With reference to FIG. 12A, the respective blocks BLK9 to BLK1 are sequentially driven with a fixed delay. Dots printed caused by driving in the manner as described above are printed on a printing medium as shown in FIG. 12*b*. Specifically, the printed line is rotated in the clockwise direction when compared with a case where the compensation amount is 0 as in FIG. 10C. However, in this illustrative embodiment, such compensation is performed when the printing medium is conveyed in the direction inclined by an angle θ as showed by an arrow (clockwise direction) from the reference of the convey direction. Thus, the line substantially parallel to the line shown in FIG. 10C is formed on the printing medium.

By the way, the inclination is compensated by the above-described first compensation processing but printing dislocations in the direction X and the direction Y are still remained. Specifically, with reference to FIG. 8D again, Pat1 and Pat2 are printed to be parallel to each other in the first compensation processing but are printed to be dislocated to each other in the direction X and the direction Y. Thus, the second compensation processing of this embodiment performs a compensation processing to dislocation in the direction Y.

The printing head of this embodiment includes a great number of printing elements arranged in the direction Y. However, all of the printing elements are not always used in an actual printing operation. End regions at both sides includes a plurality of printing elements that can jet ink but are generally not used for a printing operation, respectively. Thus, the second compensation processing of this embodiment adjusts regions of printing elements used for a printing operation to adjust the printing positions in the direction Y.

For example, the following section will describe a case where the dislocated printing position in the direction Y shown in FIG. 8D is compensated. In this case, the data processing circuit 25 moves printing data corresponding to the respective rasters of the printing head 2 received from the printing buffer 26 by two rasters in the direction Y to allocate the data to the individual printing elements to transfer the data to the driving control circuit 22. Such a dislocation amount in the direction Y is different depending not only on the inclination θ of the printing medium but also on the distance from the printing head 1. Thus, the second compensation processing as described above is preferably performed independent of the respective printing heads.

The third compensation processing of this embodiment in the direction X is performed by the timing generation circuit 21. The timing generation circuit 21 of this embodiment uses the inclination angle θ outputted from the inclination angle calculation circuit 23 to find the dislocated printing position after the first compensation processing, then compensates the encoder pulse signal 101 outputted from the rotary encoder 12 so that the dislocated printing position are compensated. Thereafter, the encoder pulse signal after the compensation is used to use the same method as the conventional one to output the timing signal 102 in the direction X to the driving control circuit 22.

Figure 2:
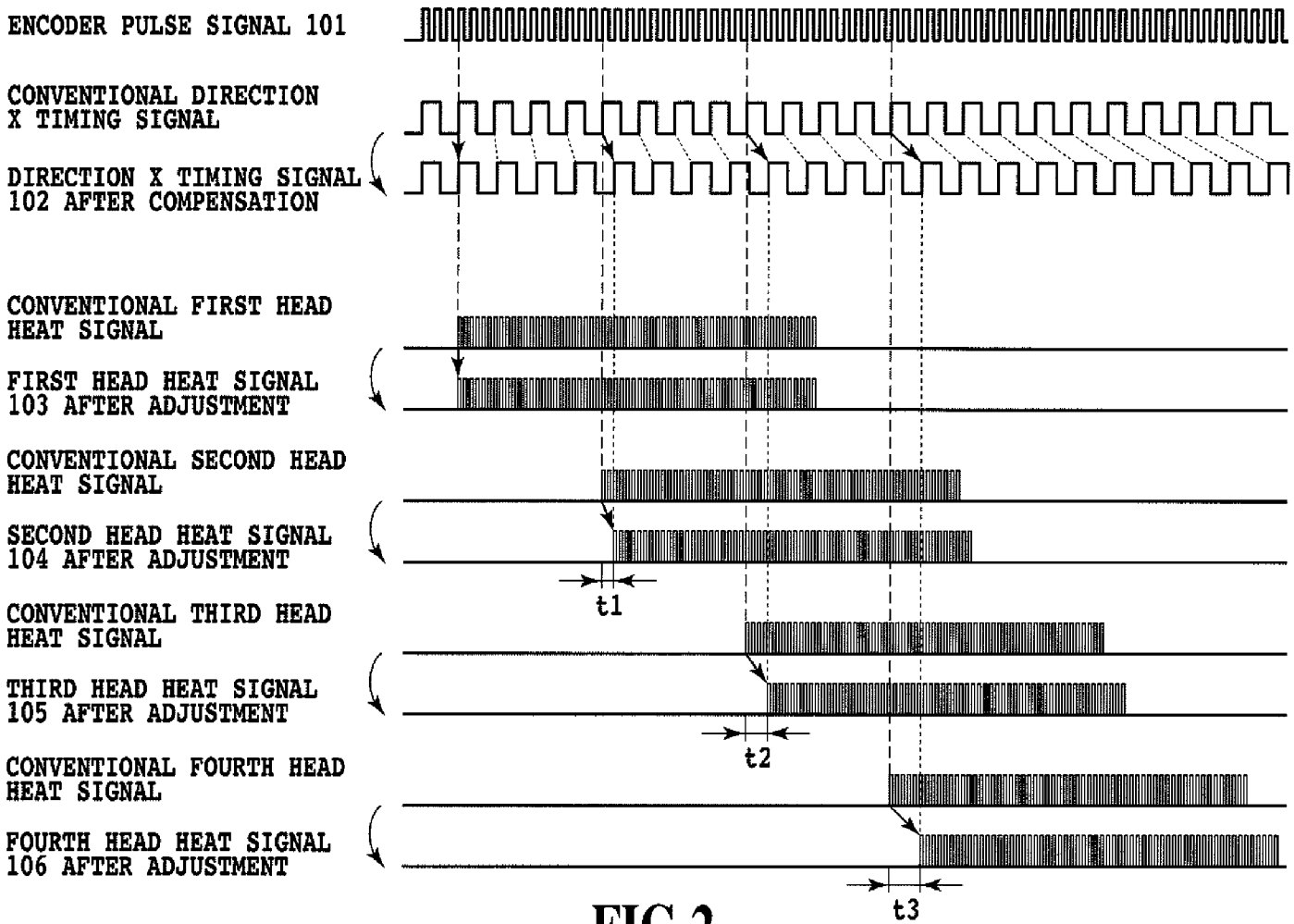
FIG. 2 is a timing chart for explaining examples of timings of the encoder pulse signal, the direction X timing signal, and the signals of the first head to the fourth head in comparison with the conventional example.

FIG. 2 is a timing chart for explaining examples of timings of the encoder pulse signal 101 in this embodiment, the direction X timing signal 102, and heat signals 103 to 106 of the first head to the fourth head in comparison with the conventional method.

When the printing medium 6 has a meander shape having an inclination angle θ larger than 0, an amount of the paper actually conveyed in the direction X is smaller than the convey amount obtained based on the rotation amount of the convey roller 7 detected by the rotary encoder 12. When the direction X timing signal is generated based on the encoder pulse signal 101 outputted from the rotary encoder 12 in spite of this, ink is jetted from the respective printing heads with a timing earlier than a preferred timing. FIG. 2 shows such timing gaps for the printing heads 2 to 4 by t1 to t3, respectively. The reference numeral t1 shows a dislocation amount of the discharge timing of the second printing head when a dot is printed at the same position as the printing position of the first head. Similarly, the reference numerals t2 and t3 show a dislocation amount of the discharge timings of the third printing head and the fourth printing head, respectively. The longer interval printing heads have therebetween, the higher the dislocation amount therebetween.

In this embodiment, the inclination angle θ is calculated based on the read data by the two line image sensors 13 and 14 to compensate the interval between the encoder pulse signals 101 by θ.

This will be described specifically. When assuming that the sensor length for which the passage of the printing medium is confirmed by the line image sensor 13 is d1, the sensor length conformed by the line image sensor 14 is d2, and the length between the two sensors (distance) is l for example, $\tan\theta=(d2-d1)/l$ is established. Then, the inclination angle calculation circuit 23 can calculate the inclination angle θ based on this formula. The direction X timing generation circuit 21 can consider that the convey amount corresponding to one pulse of the encoder pulse signal 101 is multiplied by a correct cos θ to generate the direction X timing signal 102 corresponding to a real convey amount in the direction X. Based on the direction X timing pulse signal 102 thus generated, the driving control circuit 22 generates heat signals of the respective printing heads so as to adjust, as shown in FIG. 2, to delay discharge timings by the amounts shown by t1 to t3. As a result, even when the printing medium 6 is inclined, a plurality of printing elements provided in the individual printing heads jet ink with an appropriate timing. Thus, dots of the respective colors can be printed on a printing medium at an identical position.

Second Embodiment

Figure 3:
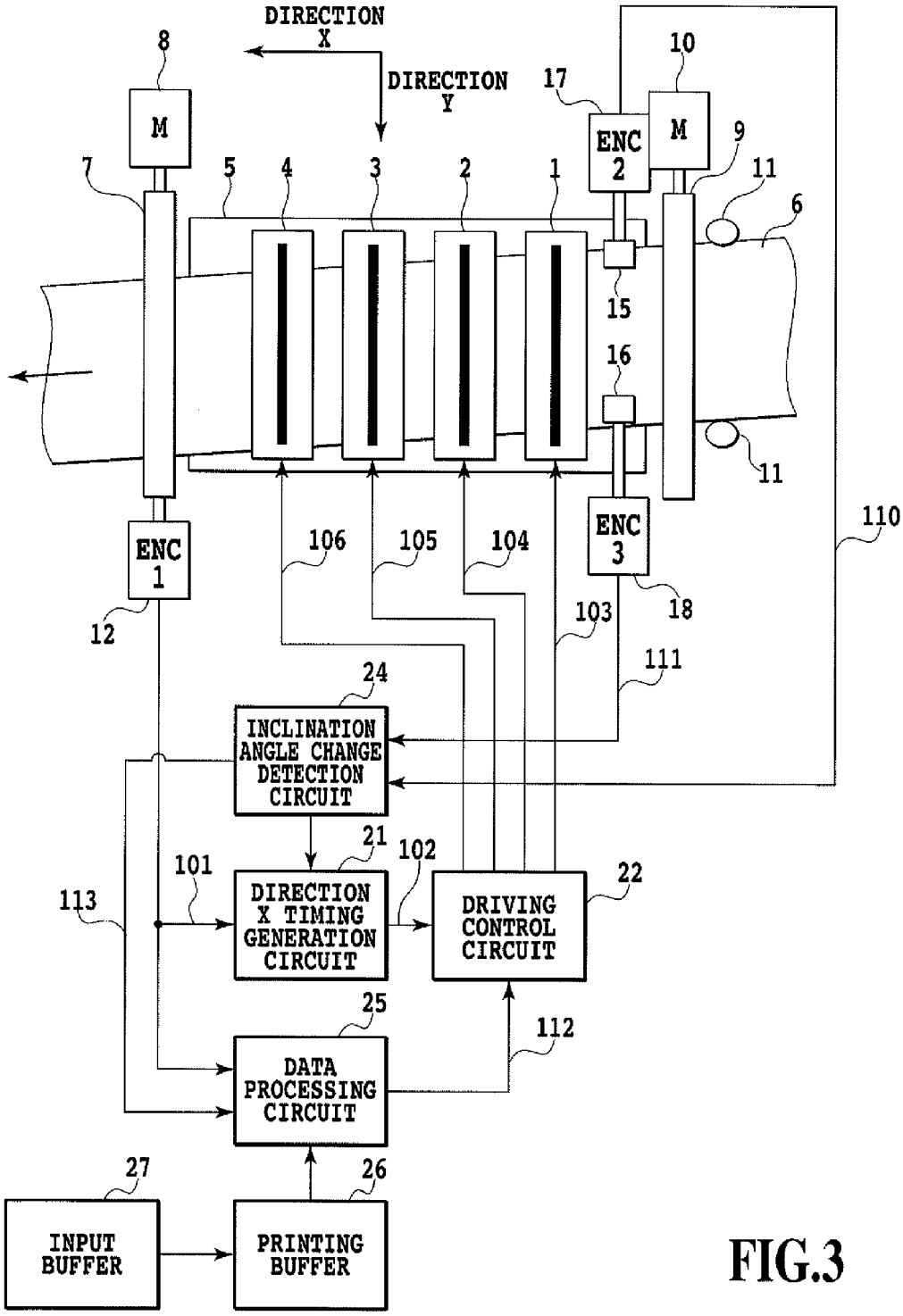
FIG. 3 is a schematic diagram for explaining the structure of the printing section of an ink jet printing apparatus used in the third embodiment of the present invention.

FIG. 3 is a schematic diagram for explaining the structure of an ink jet printing apparatus used in the third embodiment of the present invention in comparison with FIG. 5 and FIG. 1.

The reference numerals 15 and 16 denote two speed detection rollers that have a contact with both ends of a printing medium and that are rotated in accordance with the conveying of the paper. The speed detection rollers 15 and 16 are provided at the upstream side of the printing head 14 and are provided in a direction orthogonal to the convey direction with a fixed interval as shown in the drawing. The speed detection rollers 15 and 16 are connected to rotary encoders 17 and 18 for measuring the rotation speed of the speed detection rollers. The rotary encoders 17 and 18 output the encoder pulse signals 110 and 111 that are inputted to the inclination angle change detection circuit 24. The inclination angle change detection circuit 24 calculates, based on the convey speed obtained from the encoder pulse signals 110 and 111, the change amount of the inclination angle θ of the printing medium 6. Then, the inclination angle change detection circuit 24 compensates the initial inclination angle θ to output the information 113 for the inclination angle θ at the present time to the direction X timing generation circuit 21.

FIGS. 4A to 4E are a timing chart for explaining a method for calculating inclination angles θ based on a difference in the convey speed of the two rotary encoders 17 and 18. In FIGS. 4A to 4E, an angle inclined to the right side to the convey direction is represented by "+" and an angle inclined to the left side to the convey direction is represented by "−".

Figure 4A:
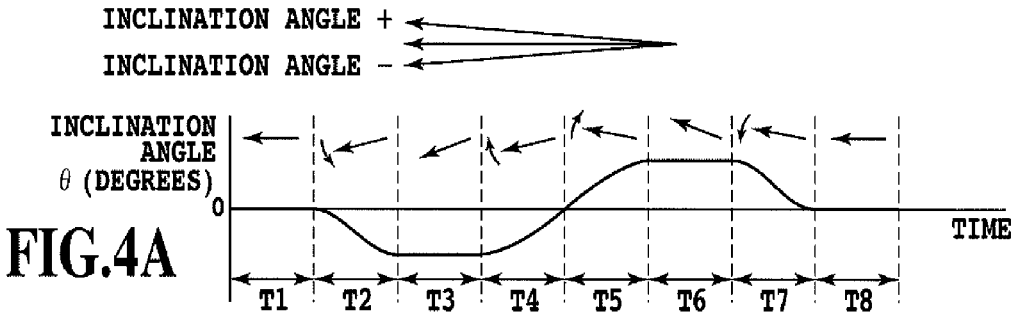
FIGS. 4A to 4E are a timing chart for explaining a method for calculating inclination angles θ based on a difference in the convey speed of two rotary encoders.

FIG. 4A shows an example of inclination angle θ which is detected by an identical period in case where the conveying of the printing medium is started while the initial convey angle θ is 0 and the printing medium subsequently has a meander shape. The identical period is determined in accordance with the convey speed. This process will be described in the following section. First, the zone T1 shows no change in the inclination angle θ. The zone T2 shows the inclination angle changed in the direction −. The zone T3 shows the inclination angle maintained in the direction −. Thereafter, the zones T4 and T5 shows the inclination angle gradually moves in the direction +. The section T6 shows the inclination angle maintained in the direction +. The zone T7 shows the inclination angle changes in the direction − again. The zone T8 shows the inclination angle returned to 0.

Figure 4B:
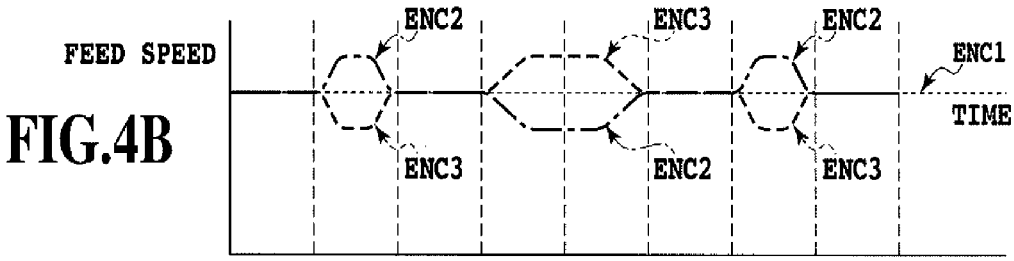

FIG. 4B shows the convey speeds of the convey roller 7 and the speed detection rollers 17 and 18 when the printing medium has a meander shape as shown in FIG. 4A, respectively. In FIG. 4B, the convey speed of the convey roller 7 detected by the rotary encoder 12 is represented by ENC1, the convey speed of the speed detection roller 15 detected by the rotary encoder 17 is represented by ENC2, and the convey speed of the speed detection roller 16 detected by the rotary encoder 18 is represented by ENC3. The convey speed ENC1 of the convey roller rotating with a fixed speed by the convey motor 8 maintains an identical value in any of the zones. In the respective zones T1, T3, T6, and T8 in which no change is caused in the inclination angle θ, ENC2 and ENC3 maintain the same convey speed as that of ENC1.

In the zones T2 and T7 in which the inclination angle changes in the direction − on the other hand, the convey speed ENC2 is faster than the convey speed ENC1 and the convey speed ENC3 is slower than the convey speed ENC1. On the contrary, in the zones T4 and T5 in which the inclination angle changes in the direction +, the convey speed ENC2 is slower than the convey speed ENC1 and the convey speed ENC3 is faster than the convey speed ENC1.

Figure 4C:
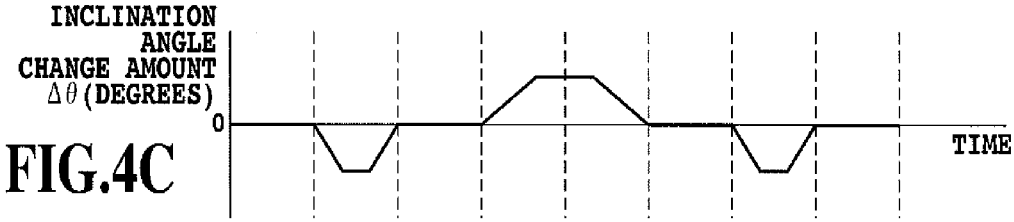

The inclination angle change detection circuit 24 in this embodiment detects, based on the difference between the convey speeds ENC2 and ENC3 thus obtained and the distance between the two speed detection rollers 15 and 16, the change amount Δθ of the inclination angle θ of the actually conveyed printing medium. FIG. 4C illustrates the change amount Δθ of the inclination angle calculated by the inclination angle change detection circuit 24. In the zones T2 and T7 where the speed detection roller 15 shows a fast convey speed and the speed detection roller 16 shows a slow convey speed, Δθ is a negative value. In the zones T4 and T5 where the speed detection roller 15 shows a slow convey speed and the speed detection roller 16 shows a fast convey speed, Δθ is a positive value.

Figure 4D:
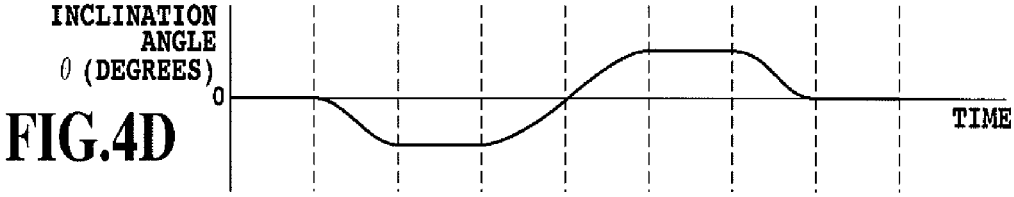
Figure 4E:
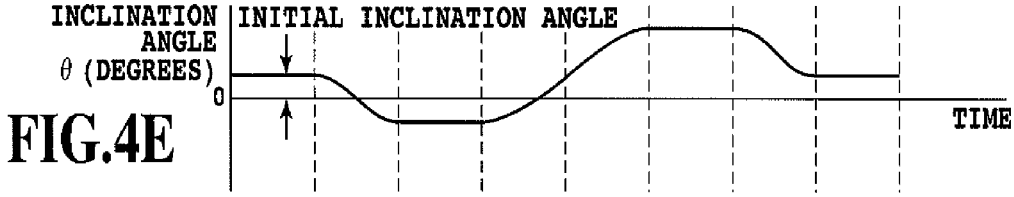

FIG. 4D shows the inclination angle θ obtained by the inclination angle change amount Δθ of FIG. 4C when the initial inclination angle is 0. When the initial inclination angle is 0 as described above, the same inclination angle as that of FIG. 4A can be calculated. FIG. 4E shows a case where an inclination angle in the direction + exists at the initial stage as in FIG. 4D. Even when the initial inclination angle is other than 0, if this value (i.e., the inclination angle at the start of the conveying) is obtained, the inclination angle obtained in the manner as described above can be added to this value to calculate an actual inclination angle θ.

In this embodiment, the inclination angle change detection circuit 24 calculates the inclination angle in the steps as described above to output the value to the direction X timing generation circuit 21 and the data processing circuit 24. Then, the same method as that already described in the first embodiment is used to compensate the angle, the direction X, and the direction Y.

In this embodiment, instead of providing sensors at both of the upstream and downstream sides of the printing head as in the first embodiment, two rotary encoders are provided only at the upstream side. Thus, a smaller space for holding the sensors is required than in the case of the first embodiment. Thus, this embodiment is preferably for a smaller printing apparatus. However, two speed detection rollers and rotary encoders are not always required at the upstream side of the printing head. Although the inclination angle is preferably detected at the upstream side that is immediately in front of the printing section, the inclination angle also may be detected at any of the upstream side and the downstream side.

By the way, the two embodiments as described above have used a structure including the line image sensor or the speed detection roller, and the encoder to use a method for calculating an inclination angle of a printing medium having a meander shape. However, the present invention is not to limited to the above structure including such a means. For example, another structure also may be used in which a mechanical structure such as a lever is provided so as to have a contact with an end of a printing medium to detect the inclination angle based on the contact position. Still another structure also may be used in which the conveying direction of the line, which is prepared in the back of the printing medium, is detected by a sensor.

Figure 14:
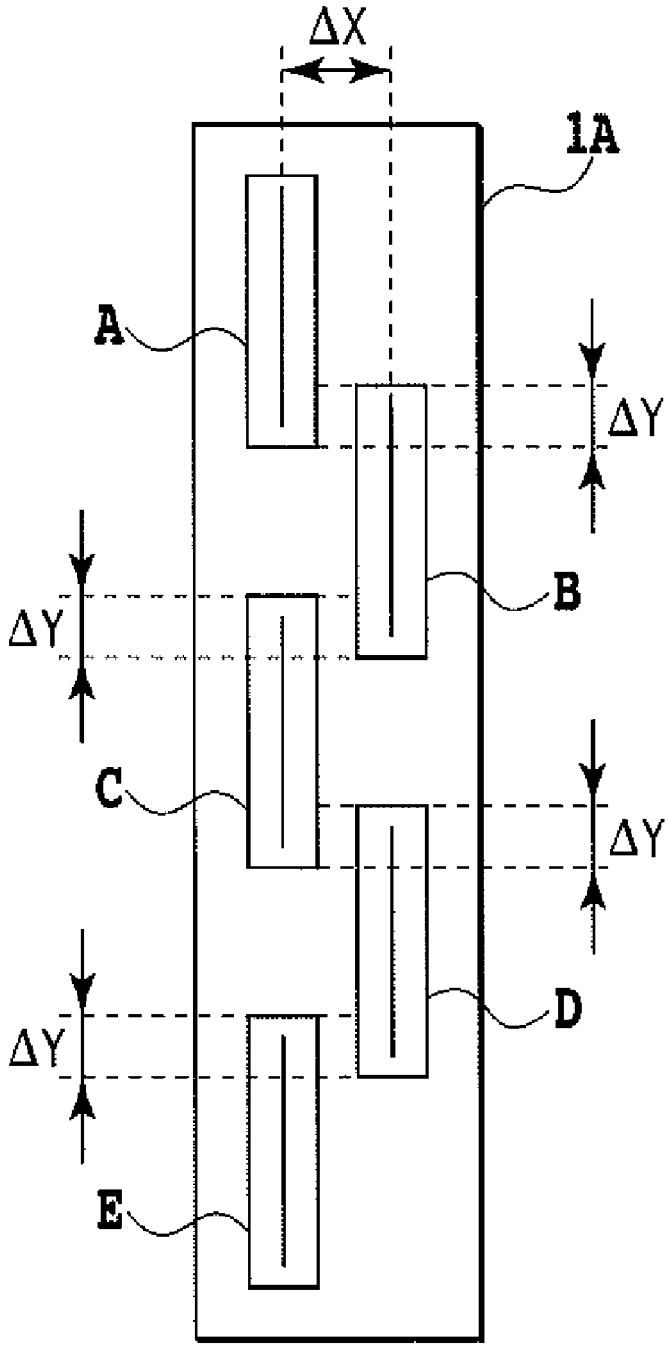
FIG. 14 is a schematic diagram for explaining the structure of the print head of another form to be used in the present invention.

FIG. 14 is a schematic diagram for explaining the structure of the print head 1A of another form to be used in the present invention. The print head 1A consists of five chips (A, B, C, D and E) arranged alternately with each other. One print head in which the plurality of chips is arranged forming a plurality of arrays is used for printing. Each of chips is provided with a printing element array having a plurality of printing element arranged in the direction Y. A region corresponding to ΔY is an overlap region of 2 chips (for example chip A and chip B). When a printing operation for the overlap region is performed, either one printing element of chip A or chip B is used for printing. Alternatively, printing elements of chip A and chip B may be used in printing in a mutually complementary manner.

Meanwhile, ΔX represents a distance between chip A and chip B in the conveying direction. Therefore, adjustment of ejection timing between chip A and chip B are performed based on the distance of ΔX.

When an inclination of print medium is detected, the above described three compensation processing may be performed for each chip.

Any structure is included in the scope of the present invention so long as the structure detects the inclination angle of a printing medium being conveyed and compensates timing to jet ink from a plurality of printing head in accordance with the resultant angle.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2006-320539, filed Nov. 28, 2006, which is hereby incorporated by reference herein in its entirety.

What is claimed is:

1. A printing apparatus in which a convey means for conveying a printing medium and a plurality of printing heads, each of which include a plurality of printing elements arranged in a direction different from a direction along which the printing medium is conveyed, are used to perform a printing operation, comprising:

acquisition means for acquiring information regarding an angle formed by a reference convey direction and a convey direction along which the printing medium is conveyed by the convey means;

driving means for driving the plurality of printing heads, respectively; and compensation means for compensating, based on the information regarding the angle, a driving timing of the driving means, wherein said acquisition means is provided at an upstream side and a downstream side of a convey path of the printing medium with respect to the plurality of printing heads and has a plurality of line image sensors to detect a position of an end of the printing medium conveyed by the convey means.

2. The printing apparatus according to claim 1, wherein the printing head ejects ink to the printing medium.

3. A printing apparatus in which a convey means for conveying a printing medium and a plurality of printing heads, each of which include a plurality of printing elements arranged in a direction different from a direction along which the printing medium is conveyed, are used to perform a printing operation, comprising:

acquisition means for acquiring information regarding an angle formed by a reference convey direction and a convey direction along which the printing medium is conveyed by the convey means;

driving means for driving the plurality of printing heads, respectively;

compensation means for compensating, based on the information regarding the angle, a driving timing of the driving means; and a plurality of rollers that are rotated by being in contact with the conveyed printing medium, wherein said acquisition means has sensors for outputting signals in accordance with the rotation of the plurality of rollers.

4. A printing apparatus in which a convey means for conveying a printing medium and a plurality of printing heads, each of which include a plurality of printing elements arranged in a direction different from a direction along which the printing medium is conveyed, are used to perform a printing operation, comprising:

acquisition means for acquiring information regarding an angle formed by a reference convey direction and a convey direction along which the printing medium is conveyed by the convey means;

driving means for driving the plurality of printing heads, respectively;

compensation means for compensating, based on the information regarding the angle, a driving timing of the driving means; and changing means for changing, based on the information regarding the angle, a printing element among the plurality of printing elements that is used for a printing operation for each of the printing heads.

5. A printing apparatus in which a convey means for conveying a printing medium and a plurality of printing heads, each of which include a plurality of printing elements arranged in a direction different from a direction along which the printing medium is conveyed, are used to perform a printing operation, comprising:

acquisition means for acquiring information regarding an angle formed by a reference convey direction and a convey direction along which the printing medium is conveyed by the convey means;

driving means for driving the plurality of printing heads, respectively; and compensation means for compensating, based on the information regarding the angle, a driving timing of the driving means, wherein said driving means performs driving on the basis of a block composed of a predetermined number of printing elements and said compensation means compensates, based on the information regarding the angle, a timing for driving the block.

* * * * *